United States Patent [19]

Nakanishi

[11] 4,411,709

[45] Oct. 25, 1983

[54] METHOD FOR MANUFACTURING ALUMINUM ALLOY CASTING

[75] Inventor: Teruo Nakanishi, Higashi, Japan

[73] Assignee: Toyo Kogyo Co., Ltd., Hiroshima, Japan

[21] Appl. No.: 347,269

[22] Filed: Feb. 9, 1982

[30] Foreign Application Priority Data

Feb. 21, 1981 [JP] Japan ..... 56-24792

[51] Int. Cl.[3] ..... B22D 25/00

[52] U.S. Cl. ..... 148/3; 164/132

[58] Field of Search ..... 148/3, 4; 164/132, 246

[56] References Cited

FOREIGN PATENT DOCUMENTS 45-15241 5/1970 Japan .

55-149772 11/1980 Japan ..... 148/3

OTHER PUBLICATIONS

Keigokin Imono Binran (Handbook for Castings of Light-Metal Alloy), edited by Nippon Sogo Imono Center.

*Primary Examiner*—L. Dewayne Rutledge

*Assistant Examiner*—Debbie Yee

*Attorney, Agent, or Firm*—Wenderoth, Lind & Ponack

[57] ABSTRACT

A method for the manufacture of an aluminum alloy casting comprises pouring a molten aluminum alloy into a mold having a sand core therein, removing a portion of the sands used to form the core from the casting after the solidification thereof, heating the casting and, simultaneously, removing the remaining portion of the sands from the casting, and machining the casting to complete an aluminum alloy article having an aperture or cavity or any other trace complemental to the core.

7 Claims, 4 Drawing Figures

METHOD FOR MANUFACTURING ALUMINUM ALLOY CASTING

BACKGROUND OF THE INVENTION

The present invention relates to a method for manufacturing a casting of light metal, particularly a aluminum alloy.

With the advent of the age of light-weight machines and tools, the demand for a casting of a light alloy is increasing, and the particular light alloy casting is currently mass-produced which requires the use of a destructible core during the manufacture thereof for the definition of a complemental aperture or cavity or any other trace complemental to the core used. In general, the temperature of the light alloy in a molten state during the pouring thereof into a mold assembly is relatively low as compared with the temperature used during the iron casting and, therefore, the destructible core tends to exhibit insufficient destructivity. In view of this, the manufacture of a light alloy casting using a destructible core poses a problem in that a relatively large amount of time-consuming and complicated labor is required to completely remove the "debris" or fragments of sands which has been used as a material for the destructible core. This substantially hampers the efficiency of mass-production of such alloys.

By way of example, where a cylinder head for an automobile internal combustion engine is to be cast using an aluminum alloy, the typical conventional method comprises, as shown in FIG. 1 of the accompanying drawings, the steps of pouring a molten aluminum alloy into a mold assembly, having therein a shaped core made of sands by the use of a resin binder such as a urea resin binder, and removing the resultant casting from the mold assembly in the form as containing the core after the solidification thereof, shaking the casting with the core therein by the application of vibrations thereto to destroy the core so that approximately half the total amount of the sands used to form the core can be removed from the casting, heating the casting to burn the resin component remaining inside the casting, either shaking or rapidly cooling the casting to allow the remaining sands to be completely flushed out of the casting, and removing the fins from the exterior of the casting. The casting so formed is subsequently heated for quenching and finally machined to make up the engine cylinder head.

According to the prior art, it is usual that the process A' including the pouring step to the fin removal step, the process B' including the heat-treatment for quenching, and the process C' including the machining step are distinctly divided to permit them to be performed in and by different divisions of labor in a factory and, therefore, it is the usual practice to deliver from the factory division performing the process A to the factory division performing the process B', the casting from which the sands and the fins have been removed completely.

In view of the above, the conventional casting method as a whole requires the heat treatment to be effected two times, one for burning the resin component remaining inside the casting during the process A' and the other for quenching during the process B'. This prior art method substantially doubles sites of heat treatment, the number of machines and equipment, the number of attendant workers and the amount of resources necessary to perform the heat treatment; thus increasing the cost of manufacture.

Since the process A', B' and C' are distinctly divided, no one of these processes have can be mingled with another one.

Apart from the above described conventional casting method, a similar casting method is well known wherein a core made of a material including salt added with water glass is used and wherein the core so made is dissolved for the removal thereof from the casting by either immersing the casting into water or pouring water into the casting. Not only is this method costly, but also, because of the salt used, the equipment as well as the resultant casting are susceptible to corrosion and, in order to avoid the possibility of being corroded, a flushing must be carried out for a substantial period of time to remove any trace of salt.

SUMMARY OF THE INVENTION

Accordingly, the present invention has been developed with a view to substantially eliminate the disadvantages and inconveniences inherent in the prior art methods and has for its essential object to provide an improved method for the manufacture of an aluminum alloy casting, wherein only a single heat treatment is effected and which is, therefore, economical to perform.

Another important object of the present invention is to provide an improved method of the type referred to above, which is effective to contribute to the energy savings without adversely affecting the quality of the resultant casting.

A further important object of the present invention is to provide an improved method of the type referred to above, which is also effective to reduce the manufacturing cost of the casting.

To this end, the improved casting method according to the present invention employs only a single heat treatment. In other words, the heat treatment generally required for the purpose of quenching is concurrently used for burning the resin component of the core remaining inside the casting. This heat treatment is, according to the present invention, effected subsequent to the rough removal of the material for the core from the casting and substantially prior to the machining of the casting.

BRIEF DESCRIPTION OF THE DRAWINGS

These and other objects and feature of the present invention will readily be understood from the following description taken in conjunction with a preferred embodiment thereof with reference to the accompanying drawings, in which.

DETAILED DESCRIPTION OF THE EMBODIMENT

Figure 1:
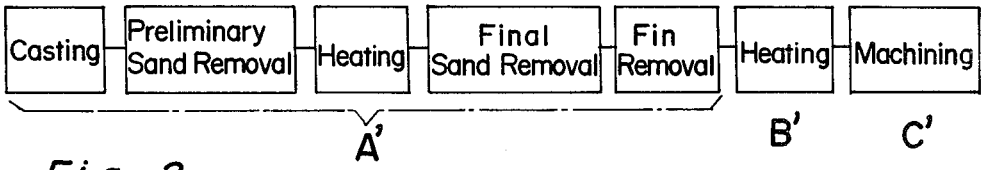
Fig. 1 Prior Art
FIG. 1 is a flow chart illustrating the prior art method for the manufacture of a light alloy casting.
Figure 2:
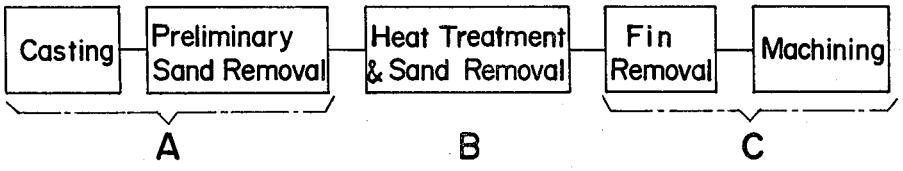
FIG. 2 is a similar flow chart showing a method according to the present invention.
Figure 3:
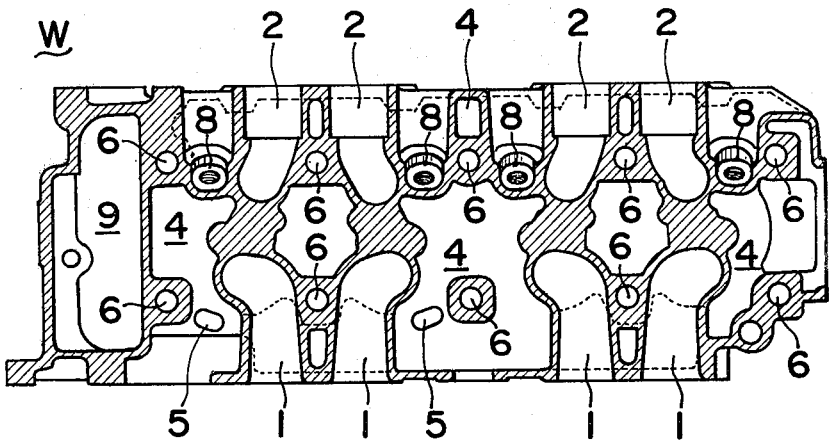
FIGS. 3 and 4 are transverse and longitudinal sectional views, respectively, of a cylinder head for an automobile internal combustion engine.
Figure 4:
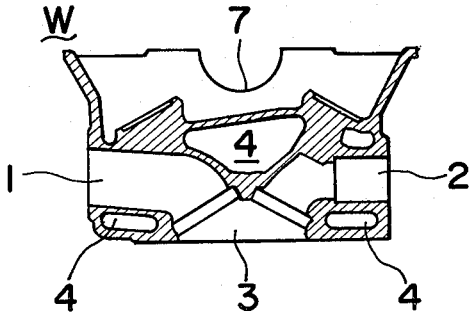

Referring first to FIGS. 3 and 4, there is shown a cylinder head W for an automobile internal combustion engine of the OHC type. This engine cylinder head W has a plurality of fuel intake ports 1, a corresponding number of exhaust ports 2, a corresponding number of combustion chambers 3, a corresponding number of water jackets 4, connecting ports 5 through which the water jackets 4 are fluid-coupled to associated water jackets (not shown) defined in a cylinder block (not shown), a plurality of holes 6 for receiving set bolts to be used for connecting the cylinder head W to the cylinder block, a bearing recess 7 for the support of a cam shaft (not shown), threaded holes 8 for the support of corresponding ignition plugs, and a cavity 9 in which a timing chain travels, the number of each of at least the elements 1, 2 and 8 being determined by the number of the engine combustion chamber 3 as is well known to those skilled in the art.

Where the cylinder head W of the construction described above is to be manufactured by the use of aluminum alloy, a casting method according to the present invention comprises, as shown in FIG. 2, a process A during which a molten aluminum alloy is poured into a mold assembly, comprising a metallic casting mold so shaped as to ultimately define the bearing recess 7, the threaded holes 8 and the cavity 9 and a core assembly made of a mixture of sands and a urea resin binder and so shaped as to ultimately define the ports 1 and 2, the combustion chambers 3, the water jackets 4 and the connecting ports 5, thereby forming an aluminum alloy casting according to a known low pressure die casting technique. After solidification, the casting is removed from the mold assembly and is separated from a gate. The casting is then shaken by the application of vibrations to allow the core assembly to destroy. Upon destruction of the core assembly, approximately half the total amount of the sands used to form core assembly can readily be removed from the casting.

From the process A, the casting with the remaining sands therein is transferred to the subsequent process B during which it receives a so-called T4 treatment, i.e., a solid solution treatment, and a quenching treatment. In other words, during the process B as shown in FIG. 2, the casting is heated in a furnace at 485° C. for 4 hours and is then quenched in a water bath.

Simultaneously with the heat treatment of the casting, the core sands remaining inside the casting is again heated and, therefore, the resin component contained therein is burned out, thereby lossening its bonding capability whereby approximately 80% of the remaining core sands (about 40% of the total amount of the sands used to form the core assembly) can flow out of the casting by gravity. The rest of the core sands (about 20% of the remaining core sands or about 10% of the total amount of the sands used to form the core assembly) which remains sticking to the interior surface of the casting is forced to separate from the interior surface of the casting when the latter is quenched into the water and can, therefore, be readily removed by flowing. Thus, the sands used to form the core assembly can substantially completely be removed from every corner of the casting during the process B.

Thereafter, the casting is kept in a heated state at about 180° C. for approximately one hour for drying in a drying furnace, which utilizes hot waste gases emitted from the heating furnace during the process B, and is then transferred from the process B to the final process C. During the process C, any possible cast fins attaching to the casting are removed by cutting and/or grinding, and the casting is subsequently machined to complete the cylinder head W shown in FIGS. 3 and 4.

From the foregoing, it is clear that the substantially complete removal of the sands used to form the core assembly in combination with the resin binder is carried out simultaneously with the heat treatment for quenching. Therefore, the necessity of the heat treatment separately from the sand removal such as required in the prior art method could advantageously be obviated. This renders the method of the present invention to be economical with the minimized number of facilities and also the minimized amount of energies and, therefore, the casting so manufactured by the method of the present invention can be low-priced with no reduced quality.

Specifically, the method of the present invention which is featured in that the sand removal is carried out simultaneously with the heat treatment as hereinbefore fully described can advantageously be employed where the low pressure die casting technique is employed to pour the molten aluminum alloy into the mold assembly having the core assembly made of sands by the use of the urea resin binder.

Although the present invention has fully been described in connection with the preferred embodiment thereof, it is to be noted that various changes and modification are apparent to those skilled in the art. By way of example, the method of the present invention is not limited to the manufacture of the engine cylinder head, but is applicable to the manufacture of any other articles made of aluminum alloy.

Therefore, such changes and modifications are to be understood as included within the true scope of the present invention unless they depart therefrom.

I claim:

1. A method for manufacturing a casting of aluminum alloy by the use of a mold having therein a destructible core made of sands and a resin binder, said casting having defined therein at least one cavity complemental in shape to the core, which method comprises the steps of:

pouring a molten aluminum alloy into the mold to form a casting therein;

removing the casting from the mold together with the core after it has been solidified;

destroying the core in the casting to such as to permit the removal of a portion of the sand used to form the core from the casting;

heating the casting to burn out and weaken the bonding capability of the resin component contained in the remaining sand located inside the casting so as to facilitate a complete removal of the sand therefrom, said casting being during the heating step, simultaneously subjected to a solid solution treatment and quenching treatment of the casting;

rapidly cooling the casting to quench it; and drying said casting.

2. A method as claimed in claim 1, wherein the resin binder is a urea resin binder.

3. A method as claimed in claim 1, wherein the pouring step is carried out by the use of a low pressure die casting technique.

4. A method as claimed in claim 1, wherein the heating is carried out at 485° C. for 4 hours and then quenched in a water bath.

5. A method as claimed in claim 1, 2, 3 or 4, wherein the casting is a cylinder head for an internal combustion engine.

6. A method as claimed in claim 1, wherein said removing step includes the separation of the casting from a gate of the mold through which the molten aluminum alloy has been poured into the mold.

7. A method as claimed in claim 1, which further comprises the step of removing any cast fins formed during the casting step from the casting subsequent to the drying step.

* * * * *